US006584822B2

(12) United States Patent
Kunz et al.

(10) Patent No.: US 6,584,822 B2
(45) Date of Patent: Jul. 1, 2003

(54) METHOD FOR WORKING A WORKPIECE

(76) Inventors: Otto Kunz, Chüssemberg 403, CH-3267 Seedorf (CH); Martin Schwab, Mauerweg 9, CH-3283 Kallnach (CH)

( * ) Notice: Subject to any disclaimer, the term of this patent is extended or adjusted under 35 U.S.C. 154(b) by 0 days.

(21) Appl. No.: 09/976,558

(22) Filed: Oct. 11, 2001

(65) Prior Publication Data

US 2002/0112521 A1 Aug. 22, 2002

Related U.S. Application Data

(62) Division of application No. 09/555,797, filed as application No. PCT/EP98/07782 on Dec. 1, 1998, now Pat. No. 6,327, 887.

(30) Foreign Application Priority Data

Dec. 7, 1997 (DE) ..... 197 54 091
Apr. 4, 1998 (DE) ..... 198 15 264

(51) Int. Cl.[7] ..... B21D 28/00
(52) U.S. Cl. ..... 72/71
(58) Field of Search ..... 72/75, 71, 89

(56) References Cited

U.S. PATENT DOCUMENTS

| | | | | | |
|---|---|---|---|---|---|
| 582,064 | A | * | 5/1897 | Hutchison | |
| 2,483,798 | A | * | 10/1949 | Veit | |
| 2,991,551 | A | * | 7/1961 | Fogle | |
| 3,295,398 | A | * | 1/1967 | Morain | |
| 3,893,818 | A | * | 7/1975 | Mickus | 72/71 |
| 4,651,548 | A | * | 3/1987 | Bernet | 72/71 |
| 5,537,850 | A | * | 7/1996 | Inatani | 72/71 |
| 6,105,410 | A | * | 8/2000 | Sauberlich et al. | 72/71 |

FOREIGN PATENT DOCUMENTS

| | | | | |
|---|---|---|---|---|
| GB | 613486 | * | 11/1948 | 72/71 |
| RU | 935200 | * | 6/1982 | 72/71 |

* cited by examiner

*Primary Examiner*—Daniel C. Crane

(57) ABSTRACT

The invention relates to a process for working a workpiece held between a counterholder and a guide by a clamping force by forming a profile, e.g. precision toothing, in a surface of the workpiece by means of a forming element, the forming element being guided toward the surface of the workpiece at an acute angle (w) to the clamping force or with a rotary/thrust movement.

8 Claims, 2 Drawing Sheets

METHOD FOR WORKING A WORKPIECE

CROSS-REFERENCE TO RELATED APPLICATION

The instant application is a divisional application of U.S. patent application Ser. No. 09/555,797 filed Jul. 18, 2000, now U.S. Pat. No. 6,327,887 which is a 371 of PCT/EP98/07782 filed Dec. 1, 1998.

BACKGROUND OF THE INVENTION

The invention relates to a process for working a workpiece held between a counterholder and a guide by a clamping force by forming a profile, e.g. precision toothing, in a surface of the workpiece.

Formed recesses, e.g. stamped recesses, in workpieces are generally formed in stamping or precision blanking presses. Here, the workpiece to be worked is clamped between a counterholder and a guide and a ram is guided toward the workpiece, this ram bringing about the stamped impression in the workpiece. The punch is generally guided in vertical alignment toward the workpiece, i.e. in an alignment perpendicular to the surface of the workpiece. Particularly when the intention is to form more difficult profiles in the workpiece, a plurality of stamping steps have to be carried out. When forming precision toothing, for example, three steps are necessary. In a first step, the workpiece is deformed or pressed in on the other side from the actual stamping surface, with the result that the stamped surface flows out of the workpiece opposite the deformation point. In a second step, slots are stamped by means of a punch on whose surface there are geometrically specific stamping members. In a subsequent stamping step, teeth are pressed into the stamped surface by a stamping punch with a profiled end face, the flanks of the slots being formed accordingly. The quality of this precision toothing leaves a lot to be desired, particularly in the case of sawteeth.

The object on which the present invention is based is to develop a method and an apparatus of the type stated at the outset by means of which even relatively difficult profiles can be formed accurately in a workpiece.

SUMMARY OF THE INVENTION

The foregoing object is achieved by virtue of the fact that forming takes place at an acute angle to the clamping force.

This method has the advantage that the desired profile is produced in the workpiece in a single working step.

In a first exemplary embodiment, the forming element itself is guided obliquely, ie. guidance is effected with a vertical and an obliquely offset component. In practice, it has been found that, for example, this makes it possible to produce significantly more accurate precision toothing, this being attributable, in particular, to better flow behavior of the stamped material at the tip of the toothing.

The profile produced should be of secondary importance. All manner of profiles, especially toothing, are conceivable. The toothing can be rectilinear or rounded. Moreover, the workpiece surface to be worked does not necessarily have to be flat. The word surface also includes the case where a profile is only stamped in over a narrow angle of the workpiece. Even this angle then forms a surface in the broader sense of the invention.

An apparatus according to the invention for carrying out this method has at least one guide and a counterholder, between which the workpiece to be worked is clamped. The guide or counterholder can be of plate-like or wall-like design or of any other desired design. The essential point is that the forming element, which is guided toward the workpiece at an acute angle, is situated in the guide. On the one hand, this can be accomplished by guiding the forming element obliquely in a corresponding aperture.

In a preferred exemplary embodiment, however, the forming element is assigned as additional wedge drive, which has a wedge surface which interacts with an oblique surface on the forming element. In addition, this forming element slides by means of a further oblique surface on a rising surface within an aperture in the guide, with the result that as the wedge drive moves vertically upward, the forming element rises obliquely and, with its pattern in its end face, produces the profile in the workpiece.

Moreover, the force does not necessarily have to be introduced directly via the tool but can also be applied by means of a hydraulic component.

The best distribution of force between the wedge drive and the forming element is probably obtained when the first oblique surface of the forming element, said oblique surface sliding on the rising surface, encloses an angle of 80 to 100° with the second oblique surface, which interacts with the wedge surface on the wedge drive, depending on the length and depth of the stamped impression.

In another exemplary embodiment, a forming element is guided between the counterholder and the guide, in the gap in which the workpiece itself is also clamped fast. This means that, in this case, the forming element produces on the lateral surface of the workpiece a profile which corresponds to a pattern on the forming element.

For the sake of simplicity, the movement of the forming element is once again effected by means of a wedge drive, which is guided in apertures in the counterholder or the guide. Here, a wedge surface of the wedge drive interacts with an oblique surface on the forming element, with the result that the forming element is driven toward the lateral surface of the workpiece.

In another exemplary embodiment of the invention, a profile is formed in the workpiece by a rotary/thrust movement of a corresponding forming element which has the pattern for the profile on its end face. In this case, there is a suitable aperture in the guide, allowing the forming element to move vertically upward in this guide with a simultaneous rotary motion.

BRIEF DESCRIPTIONS OF THE DRAWINGS

Further advantages, features and details of the invention will emerge from the following description of preferred exemplary embodiments and with reference to the drawing, in which FIG. 1 shows a schematically illustrated cross section through part of an apparatus according to the invention for the production of a workpiece;

DETAILED DESCRIPTION

Figure 1:
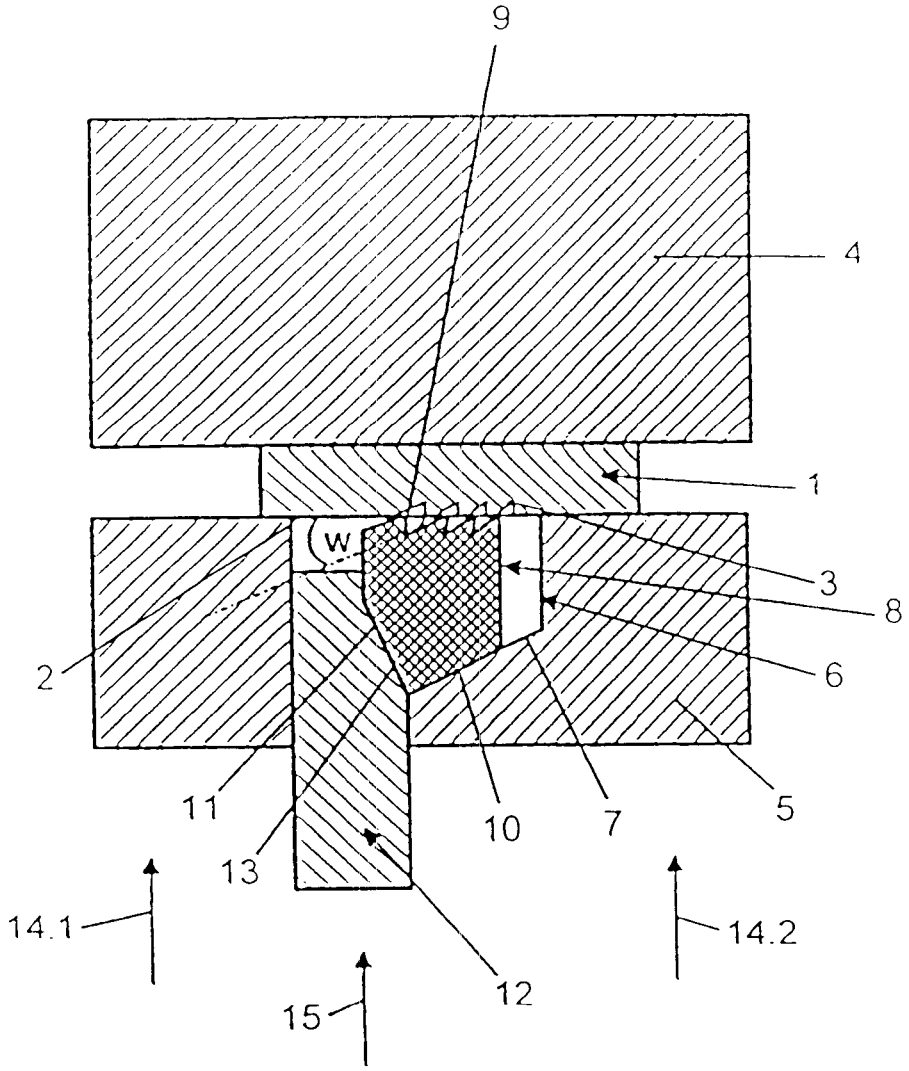
Figure 2:
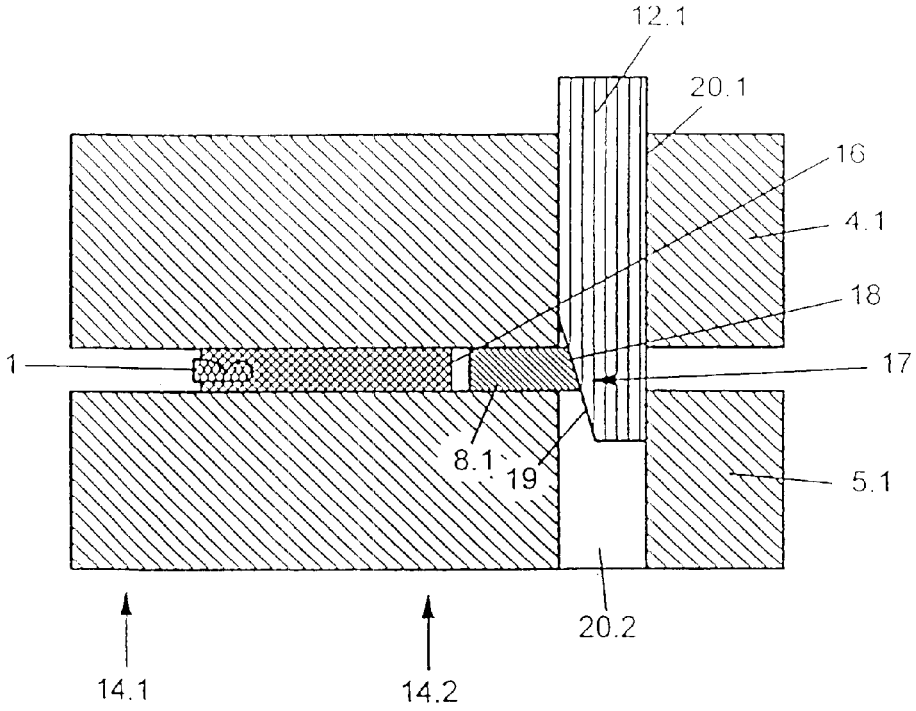
FIG. 2 shows a schematically illustrated cross section through part of another exemplary embodiment of an apparatus according to the invention for the production of a workpiece.

According to FIG. 1, a profile, e.g. precision toothing 3, is formed in a work surface 2 of a workpiece 1.

This workpiece 1 is clamped between a counterholder 4 and a guide 5.

Provided in the guide 5 is an aperture 6 which, by means of a rising surface 7, forms an obliquely rising rest for a forming element 8. In an end face oriented toward the workpiece 1, this forming element 8 has a pattern 9 of a profile corresponding to the profile 3 which is to be formed in the workpiece 1 by this pattern 9.

Opposite the pattern 9, the forming element 8 has a first oblique surface 10, which slides on the rising surface 7. Running at an angle of about 90° to this first oblique surface 10 is a second oblique surface 11 which, in turn, interacts with a wedge drive 12. For this purpose, the wedge drive 12 engages the second oblique surface 11 by means of a wedge surface 13.

The present invention operates as follows:

The workpiece 1 is clamped between the counterholder 4 and the guide 5. A vertical force denoted by the arrows 14.1 and 14.2 acts as the clamping force.

A thrust force 15 which pushes the wedge drive 12 vertically upward toward the workpiece 1 is applied to the wedge drive 12. During this process, the wedge surface 13 pushes the forming element 8 to the right, the latter sliding on the rising surface 7, thus allowing the pattern 9 to be pressed into the workpiece 1 and produce the profile 3 of varying depth. This takes place at an acute angle w toward the work surface 2 of the workpiece 1.

In another exemplary embodiment of the apparatus according to the invention, the workpiece 1 is likewise held between a counterholder 4.1 and a guide 5.1. Here too, the clamping force 14.1 and 14.2 acts. In this exemplary embodiment, however, a profile is to be formed in the lateral surface 16 of the workpiece 1. Once again, a forming element 8.1 is provided for this purpose, although this is guided between the counterholder 4.1 and the guide 5.1. A forming direction is denoted by the arrow 17.

The forming element 8.1 has an oblique surface 18 which interacts with a wedge surface 19 of a wedge drive 12.1. This wedge drive 12.1 is guided in apertures 20.1 and 20.2 in the counterholder 4.1 and the guide 5.1.

Figure 3:
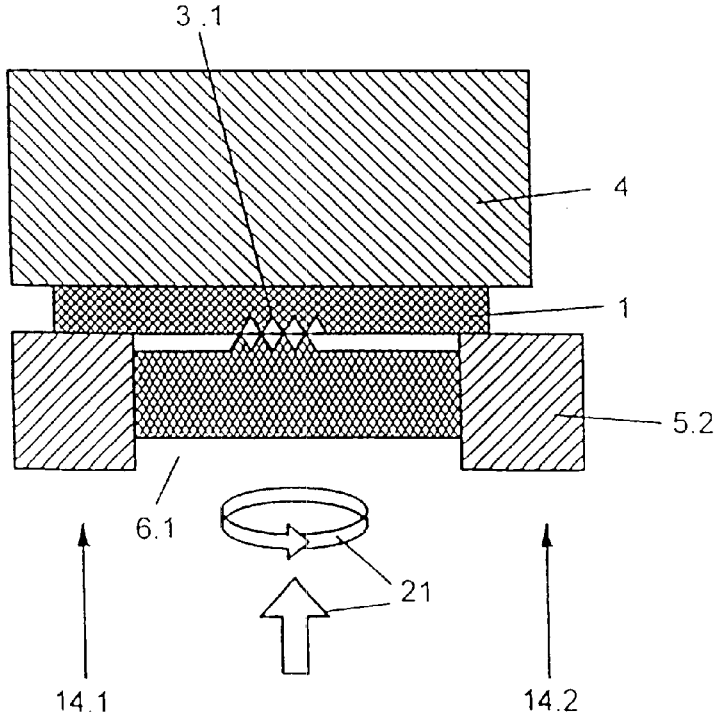
FIG. 3 shows a schematically illustrated cross section through part of another exemplary embodiment of an apparatus according to the invention for the production of a workpiece.

According to FIG. 3, a profile 3.1 is to be formed in the workpiece 1 by a rotary/thrust movement. For this purpose, a forming element 8.2 is guided in a corresponding aperture 6.1 in the guide 5.2, a corresponding rotary/thrust drive being denoted purely schematically by 21.

What is claimed is:

1. A method for forming a profile on a surface of a workpiece comprising:

clamping a workpiece having a work surface and a thickness between a counterholder and a guide which contacts a portion of the work surface with a clamping force, said guide having an aperture;

providing a forming element having a surface substantially parallel to the work surface, the surface having a pattern for forming a profile on the work surface of the workpiece;

guiding the forming element through the aperture toward the clamped work surface for contacting the work surface; and providing relative rotational movement between the forming element and the work surface while in contact with the work surface for forming a profile on the work surface of the workpiece having a depth less than the thickness of the workpiece.

2. A method according to claim 1, including the step of rotating the forming element to provide relative rotational movement.

3. An apparatus for forming a profile on a surface of a workpiece comprising:

clamping means for clamping a workpiece having a work surface and a thickness between a counterholder and a guide which contacts a portion of the work surface with a clamping force, said guide having an aperture;

profile forming means having a surface substantially parallel to the work surface, the surface having a pattern for forming a profile on the work surface of the workpiece, wherein the profile has a height which is less than the thickness of the workpiece;

means for guiding the forming element through the aperture toward the clamped work surface for contacting the work surface; and means for providing relative rotational movement between the forming element and the work surface while in contact with the work surface for forming a profile on the work surface of the workpiece the depth of which is less than the thickness of the workpiece.

4. An apparatus according to claim 3, including means for rotating the profile forming means to provide relative rotational movement.

5. A method for forming a profile on a surface of a workpiece comprising:

clamping a workpiece having a work surface and a thickness between a counterholder and a guide which contacts a portion of the work surface with a clamping force;

providing a forming element having a surface substantially parallel to the work surface, the surface having a pattern for forming a profile on the work surface of the workpiece;

guiding the forming element toward the clamped work surface for contacting the work surface; and providing relative rotational movement between the forming element and the work surface while in contact with the work surface for forming a profile on the work surface of the workplace having a depth less than the thickness of the workpiece.

6. A method according to claim 5, including the step of rotating the forming element to provide relative rotational movement.

7. An apparatus for forming a profile on a surface of a workpiece comprising:

clamping means for clamping a workpiece having a work surface and a thickness between a counterholder and a guide which contacts a portion of the work surface with a clamping force;

profile forming means having a surface substantially parallel to the work surface, the surface having a pattern for forming a profile on the work surface of the workpiece wherein the profile has a height which is less than the thickness of the workpiece;

means for guiding the forming element toward the clamped work surface for contacting the work surface; and means for providing relative rotational movement between the forming element and the work surface while in contact with the work surface for forming a profile on the work surface of the workpiece the depth of which is less than the thickness of the workpiece.

8. An apparatus according to claim 7, including means for rotating the profile forming means to provide relative rotational movement.

* * * * *